US008103154B2

(12) United States Patent
Steinel et al.

(10) Patent No.: US 8,103,154 B2
(45) Date of Patent: Jan. 24, 2012

(54) HOT AIR BLOWER AND SYSTEM COMPRISING A HOT AIR BLOWER AND AT LEAST ONE CODING UNIT

(75) Inventors: Ingo H. Steinel, Herzebrock-Clarholz (DE); Thomas Schreckenberger, Gütersloh (DE)

(73) Assignee: Steinel GmbH, Herzebrock-Clarholz (DE)

( * ) Notice: Subject to any disclaimer, the term of this patent is extended or adjusted under 35 U.S.C. 154(b) by 565 days.

(21) Appl. No.: 12/233,747

(22) Filed: Sep. 19, 2008

(65) Prior Publication Data

US 2009/0080872 A1 Mar. 26, 2009

(30) Foreign Application Priority Data

Sep. 24, 2007 (DE) ..... 20 2007 013 430 U

(51) Int. Cl.
*F24H 3/02* (2006.01)

(52) U.S. Cl. ..... 392/379; 392/347; 392/384

(58) Field of Classification Search ..... None
See application file for complete search history.

(56) References Cited

U.S. PATENT DOCUMENTS

| | | | | |
|---|---|---|---|---|
| 6,424,252 | B1 * | 7/2002 | Adler | 340/311.2 |
| 7,096,601 | B2 * | 8/2006 | Lyu et al. | 34/595 |
| 7,373,737 | B2 * | 5/2008 | Lyu et al. | 34/595 |
| 7,572,412 | B2 * | 8/2009 | Yang | 422/124 |
| 2006/0225301 | A1 * | 10/2006 | Lyu et al. | 34/595 |
| 2006/0225302 | A1 * | 10/2006 | Lyu et al. | 34/595 |
| 2007/0014549 | A1 * | 1/2007 | Demarest et al. | 392/393 |
| 2008/0116274 | A1 * | 5/2008 | Aldridge | 235/440 |
| 2008/0181590 | A1 * | 7/2008 | Radwill et al. | 392/385 |
| 2010/0307019 | A1 * | 12/2010 | Park et al. | 34/90 |
| 2011/0044671 | A1 * | 2/2011 | Amiran et al. | 392/441 |

FOREIGN PATENT DOCUMENTS

| | | | |
|---|---|---|---|
| DE | 4005475 | A1 | 8/1990 |
| DE | 29816758 | U1 | 11/1998 |

* cited by examiner

*Primary Examiner* — Thor Campbell
(74) *Attorney, Agent, or Firm* — Bachman & LaPointe, P.C.

(57) ABSTRACT

A hot air blower has at least one fan impeller and at least one electrical heating device. The hot air blower is designed to interact with a coding unit provided with coding. The hot air blower is releasably connected to the coding unit. The coding unit is designed to predefine at least one of heating power and hot air temperature of a heating device in the hot air blower on the basis of the coding.

19 Claims, 3 Drawing Sheets

HOT AIR BLOWER AND SYSTEM COMPRISING A HOT AIR BLOWER AND AT LEAST ONE CODING UNIT

BACKGROUND OF THE INVENTION (1) Field of the Invention

The invention relates to a hot air blower comprising at least one fan impeller and at least one electrical heating device. The invention also relates to a system comprising a hot air blower and at least one coding unit.

(2) Prior Art

A hot air blower, which is also referred to as a heat gun, is an electric tool which can be used to heat a work area (workpiece) in a targeted manner. For this purpose, ambient air is drawn in using at least one fan impeller, is heated using the heating device and is then blown out to the work area through an outlet pipe. The following customary areas of use for hot air blowers are mentioned merely by way of example: removing adhesive films, welding plastics, deforming plastics, removing coats of varnish or paint, in particular on wood or metal, disinfecting laboratory equipment, drying articles. For the different areas of use, there are different optimum processing temperatures which must be set by the operator, for example using a potentiometer or, in the case of electronic hot air blowers, by appropriately operating a control unit. In this case, temperatures may usually be selected from a temperature range of between approximately 50° C. and approximately 650° C. or above. In industrial use, the problem exists that the user does not have any knowledge of the optimum operating temperature ranges and is usually inclined to operate the hot air blower at full heating power, which may result in damage to the workpieces to be machined.

SUMMARY OF THE INVENTION

Therefore, the invention is based on the object of proposing an improved hot air blower in which an optimum heating power, which cannot be arbitrarily varied by the user, can be set in a simple manner for the respective area of use. The object is also to propose a correspondingly improved system comprising such a hot air blower.

This object is achieved by the hot air blower and the system of the present invention.

Advantageous developments of the invention are specified in the subclaims. All combinations of at least two of the features disclosed in the description, the drawings and/or the figures also fall within the scope of the invention.

The invention is based on the concept of designing the hot air blower in such a manner that the heating power of the electrical heating device and thus the temperature of the hot air that is blown out can be predefined using a coding unit in the hot air blower, the coding unit preferably being able to be docked to the hot air blower in a releasable manner. The user need not set the optimum operating temperature (hot air temperature) using a rotary regulator or using setting buttons as in the prior art but rather, in the case of a system which is designed according to the concept of the invention and comprises a hot air blower and a plurality of coding units which are, in particular, coded differently, by selecting a coding unit which has been identified for the respective intended use and connecting this coding unit to the hot air blower. For reasons of safety, the hot air blower is preferably designed in such a manner that at least the electrical heating device cannot be operated without a coding unit being docked to the hot air blower. The risk of incorrect operation and thus the risk of damage to workpieces to be heated are minimized in the case of a hot air blower designed according to the concept of the invention. In addition, a hot air blower designed in such a manner can be operated in a simple and safe manner without having to have knowledge of the operating temperature which is optimum for a particular intended use. In particular, the heating power/heating temperature predefined by the coding unit cannot be arbitrarily changed by the user.

One development of the invention advantageously provides for the coding unit to essentially comprise only one conductor track which is arranged in a housing. In a preferred manner in this case, only one conductor track is preferably applied to a printed circuit board. In this case, a coding unit designed in such a manner manages without resistance elements, as a result of which it is also possible to dispense with complicated fitting of such electrical components to the coding unit and all associated process steps. A coding unit designed according to this specification preferably has at least two contact points which are at a distance from one another and can be used to electrically contact-connect the coding unit to the hot air blower at a special docking point. The different coding of a plurality of different coding units can preferably be achieved by arranging at least one contact point for contact-connecting the hot air blower at a different position in different coding units, that is to say the positions of at least one contact point in at least two different coding units do not correspond. Coding units which are coded differently in such a manner contact-connect the hot air blower, for example an electrical circuit which, in particular, is in the form of an evaluation circuit or an analog input of a control unit or digital inputs of an electrical control unit or microprocessor of the hot air blower, at different points and can thus predefine or limit the heating power, in particular the maximum heating power, and thus the hot air temperature, in particular the maximum hot air temperature, when the hot air blower is designed in an appropriate manner. In other words, different contact point combinations of the hot air blower or an electrical circuit of the hot air blower are selected using differently coded coding units, that is to say different contact points are connected to one another in an electrically conductive manner. It is within the scope of the invention to provide a lighting means, for example an LED, on the coding unit in order to identify the operating state, such a lighting means advantageously being dispensed with.

One possible way of achieving two different heating powers using two differently coded coding units is to provide at least one electrical resistor, which is arranged in an electrical supply line of the heating device, inside the hot air blower, which resistor is bridged by means of an appropriate arrangement of the contact points, that is to say appropriate coding, of a first coding unit, and is not bridged by appropriate coding, that is to say arrangement of contact points, of the second coding unit. As a result of the fact that the resistor is bridged using the first coding unit, greater electrical power is thus available for the heating device, thus resulting in greater heating power.

One embodiment in which a plurality of resistors, which are connected in series and are arranged in an electrical supply line of the heating device, are provided is preferred, in which case, for example, no resistor, one resistor or a plurality of resistors can be bridged depending on the coding of the coding unit, that is to say depending on the arrangement of the contact points, as a result of which the heating power and thus the hot air temperature can be predefined.

The at least one resistor which is arranged in the electrical supply line of the heating device in the hot air blower and interacts with the coding unit is preferably a PTC resistor in order to avoid an automatic increase in the heating power on account of a resistance which falls as the device temperatures rise.

In addition or preferably as an alternative to the provision of resistors which are arranged in an electrical supply line of the heating device and interact with the coding unit, one preferred embodiment of the invention provides a (an electronic) control unit which can be used to determine the coding, that is to say, in particular, the arrangement of the contact points, of the coding unit, the control unit being designed to regulate the hot air temperature and thus the heating power on the basis of the ascertained coding of the coding unit.

According to one particularly preferred embodiment, the control unit is electrically conductively connected to an evaluation circuit in order to ascertain the coding of the coding unit, the evaluation circuit having at least one resistor, preferably a plurality of resistors which are particularly preferably connected in series, in which case, for example, no resistor, one resistor or a plurality of resistors can be bridged depending on the coding of the coding unit contact-connected to the evaluation circuit, the coding of the coding unit being able to be ascertained using the control unit by means of a current and/or voltage measurement depending on the arrangement of the resistors. In other words, the evaluation circuit forms an analog input of the control unit.

One embodiment in which at least two of the series-connected resistors, preferably all of the series-connected resistors, have different dimensions is particularly preferred. If, for example, three differently dimensioned resistors and four docking points are provided, eight different coding possibilities result. Sixteen different codings can be achieved with four resistors and five docking points.

One embodiment which does not provide a control unit having an (analog) evaluation circuit but in which the control unit, in particular a microprocessor, has a plurality of digital inputs is particularly advantageous, different digital inputs being able to be connected to one another on the basis of the coding of the coding unit. In this case, the (binary) switching pattern predefined by the coding of the coding unit defines the heating power and/or heating temperature to be set. One embodiment of the hot air blower, in which digital inputs of the control device are connected in different ways only using an electrical line of the coding unit, which has at least two contact points, is particularly preferred. In this case, the coding is thus solely predefined by the position of the contact points of the coding unit.

A development of the invention advantageously provides for the heating device to have a plurality of heating segments. The heating segments are connected to one another in different ways on the basis of the coding of the coding unit or a choice is made between individual heating segments or a plurality of heating segments. For example, it is thus conceivable to connect two heating segments in series with a first coding unit, to supply only one of the heating segments with electrical energy, that is to say to select it, using a second coding unit having coding which is different from the coding of the first coding unit, and to connect both heating segments in parallel with a third coding unit. The coding of the coding units thus has a direct effect on the selection of the heating segments (preferably heating coils) which are used individually or in combination.

One embodiment in which an insertion opening for the coding unit is provided in a housing of the hot air blower is particularly advantageous, said insertion opening being able to accommodate at least sections of the coding unit so that the latter can be releasably secured to the hot air blower.

As mentioned initially, the invention also leads to a system comprising a hot air blower (described above) and at least one coding unit which can be releasably connected to the hot air blower and is designed to predefine the heating power and/or hot air temperature, in particular the maximum heating power and/or hot air temperature, of the heating device in the hot air blower on the basis of its coding by interacting with the hot air blower.

One embodiment of the system in which at least two differently coded coding units are provided for the hot air blower is preferred, the coding of the respective coding units preferably being designed to contact-connect an electrical evaluation circuit or a supply line of the heating device of the hot air blower by means of an appropriate arrangement of the contact points.

It is particularly advantageous if the differently coded coding units are provided with an identification, for example an inscription, a symbol and/or coloring, which identifies the intended use. Additionally or alternatively, the heating power and/or heating temperature which can be achieved using the coding unit can be indicated on the coding unit.

BRIEF DESCRIPTION OF THE DRAWINGS

Further advantages, features and details of the invention emerge from the following description of preferred exemplary embodiments and with reference to the drawings, in which.

In the figures, the same components and components having the same function are identified using the same reference symbols.

DETAILED DESCRIPTION OF THE PREFERRED EMBODIMENT(S)

Figure 1:
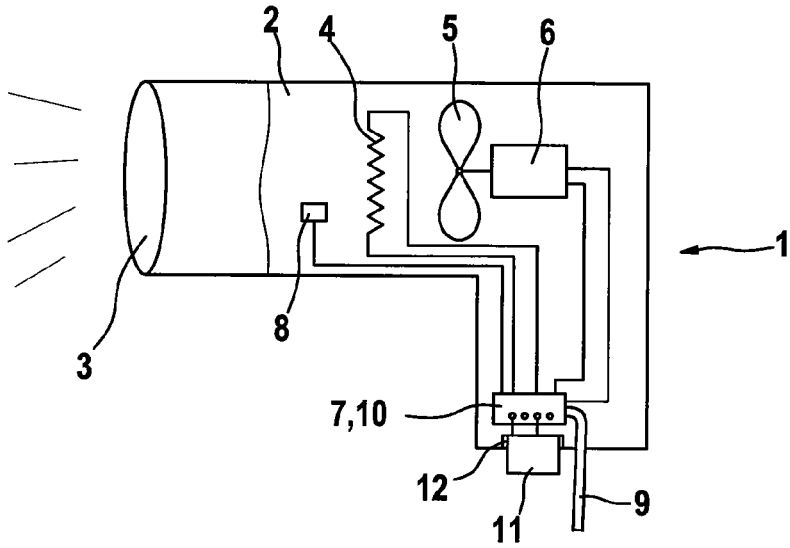
FIG. 1: shows a highly diagrammatic illustration of a hot air blower which is in the form of a handheld device and to which a coding unit is releasably connected.

FIG. 1 shows a preferred exemplary embodiment of a hot air blower 1 which is in the form of a handheld device. The hot air blower has a housing 2 with an outlet pipe 3. A diagrammatically indicated electrical heating device 4 and a diagrammatically indicated fan impeller 5 with an electrical drive motor 6 are situated inside the housing 2.

The electrical drive motor 6 and the heating device 4 are supplied with electrical energy by means of a control unit 7 which is connected to a temperature sensor 8 so as to conduct signals, said electrical energy being supplied to the hot air blower 1 via a connecting cable 9.

The control unit 7 is connected to an evaluation circuit 10 which interacts with a coding unit 11 which can be releasably accommodated in an insertion opening 12 in the housing 2.

As can be seen from FIG. 1, the coding unit 11 contact-connects the evaluation circuit 10 at two docking points (electrical contacts). In this case, the arrangement of the contact points of the coding unit 11 determines the coding and thus predefines the heating power to be set by the control unit 7, in particular by regulating the hot air temperature.

Figure 2:
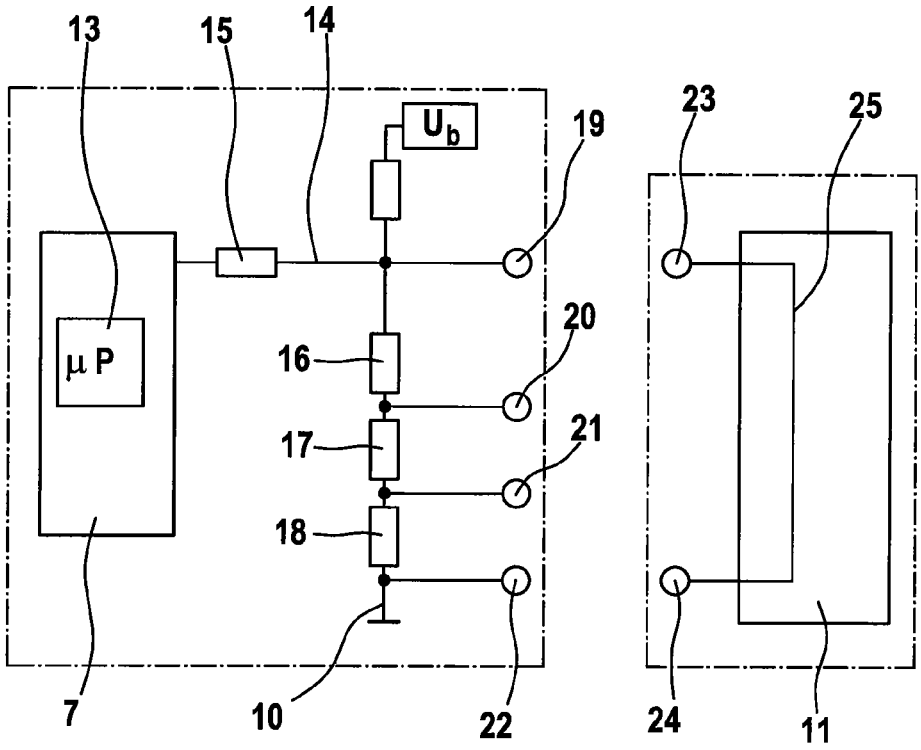
FIG. 2: shows an illustration of a control unit with an evaluation circuit, and a coding unit.

FIG. 2 diagrammatically illustrates one possible embodiment of a control unit 7 with an evaluation circuit 10. A microprocessor 13 of the control unit 7 can be seen, the control unit 7 being connected to a series circuit of resistors of the evaluation circuit 10 by means of a connecting line 14 having a resistor 15. The evaluation circuit 10 comprises a first, a second and a third resistor 16, 17, 18 which are connected in series and are supplied with a supply voltage $U_b$. In the exemplary embodiment shown, the evaluation circuit 10 has four docking points 19, 20, 21, 22 which are in the form of printed circuit board direct connectors, two docking points 19, 20, 21, 22 being able to be respectively connected to the contact points 23, 24 (one docking point for each contact point) of the coding unit 11. One, two or three of the resistors 16, 17, 18 can be bridged depending on the arrangement of the contact points 23, 24, which can be detected in turn by the control unit 7, the control unit setting the heating power on the basis of the arrangement of the contact points 23, 24, that is to say the coding, of the coding unit 11, in particular by regulating the hot air temperature.

As can be seen from FIG. 2, the coding unit 11 comprises, as an electrical component, only one electrical line 25 which is arranged on a printed circuit board and connects the contact points 23, 24, that is to say the free ends of the electrical line 25, to one another in an electrically conductive manner. Furthermore, the coding unit 11 advantageously does not comprise any additional electrical components such as fixed resistors, etc.

In the exemplary embodiment shown in FIG. 2, all of the series-connected resistors 16, 17, 18 of the evaluation circuit 10 are bridged, as a result of which the electrical power provided by the control unit 7 for the heating element 4 is at a maximum.

Figure 3:
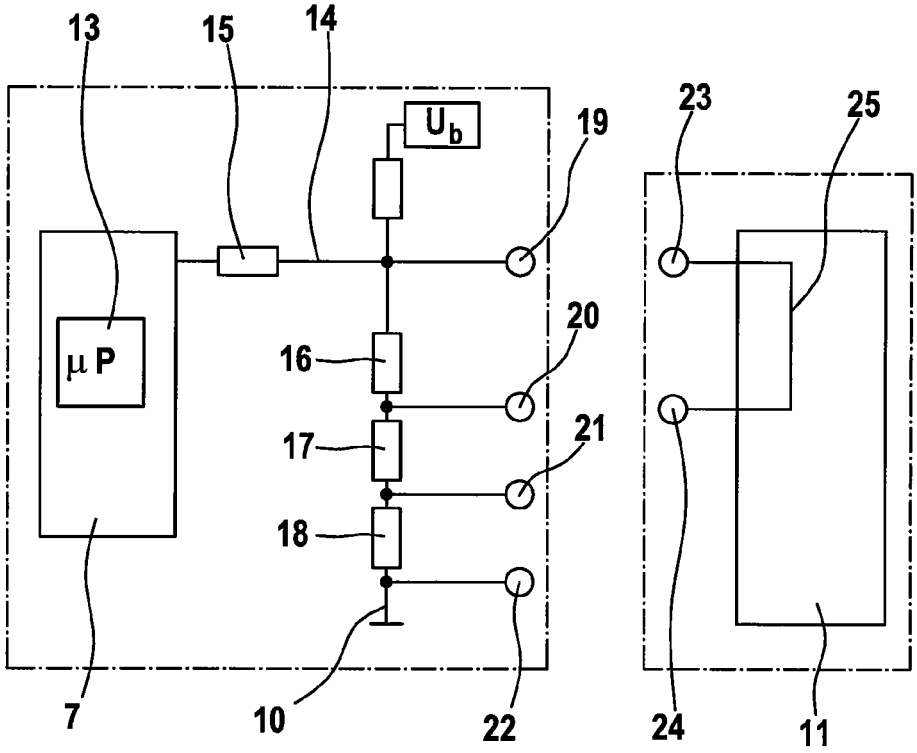
FIG. 3: shows the control unit with the evaluation circuit according to FIG. 2 but with a differently coded coding unit.

FIG. 3 shows a slightly modified combination of a control unit 7 with an evaluation circuit 10 and a coding unit 11. In order to avoid repetition, only the differences from the exemplary embodiment according to FIG. 2 are discussed. With regard to the similarities, reference is made to the preceding description of the figures and to FIG. 2.

The only difference from the exemplary embodiment according to FIG. 2 is that the coding unit 11 used has coding which is different from the coding unit 11 according to FIG. 2. This is achieved by virtue of the fact that the two contact points 23, 24 of the coding unit 11, which are connected to one another by means of an electrical line 25 which is shorter than that in FIG. 2, are arranged at a shorter distance from one another. Only the first resistor 16 of the evaluation circuit can be bridged using the coding unit 11 according to FIG. 3 by virtue of the contact points 23, 24 interacting with the docking points 20, 21 in an electrically conductive manner by releasably connecting the coding unit 11 to the hot air blower 1.

Figure 4:
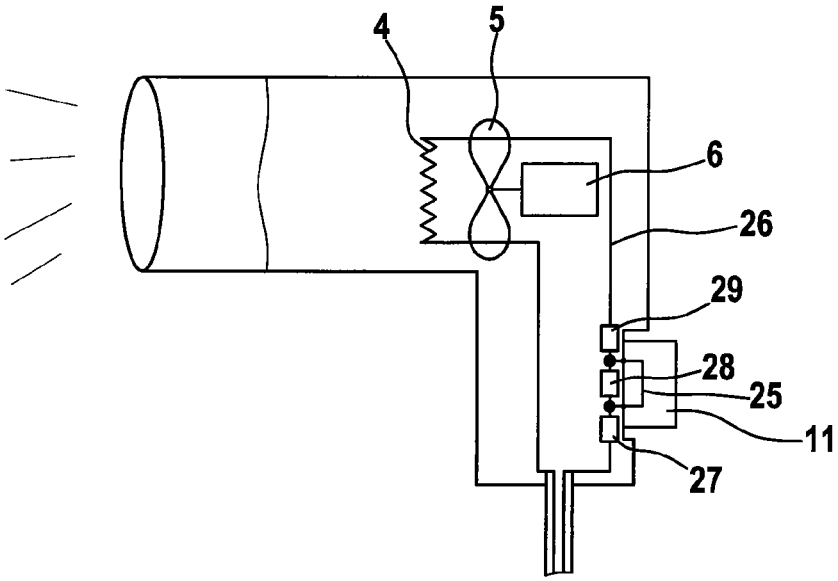
FIG. 4: shows a highly diagrammatic illustration of the alternative embodiment of a hot air blower.

FIG. 4 shows an alternative exemplary embodiment without an electronic control unit. It can be seen that three resistors 27, 28, 29 which are connected in series and are in the form of PTC resistors are arranged in a supply line 26 for supplying electrical energy to an electrical heating device 4. As in the exemplary embodiments described above, a coding unit 11 which interacts with the hot air blower 1 and can be releasably secured to the latter has only one electrical line 25 with two contact points which are not shown for reasons of clarity, a different number of resistors 27, 28, 29 being able to be bridged by means of a different arrangement of the contact points 23, 24, as a result of which the heating power can be set depending on the selection of an appropriately coded coding unit 11.

Figure 5:
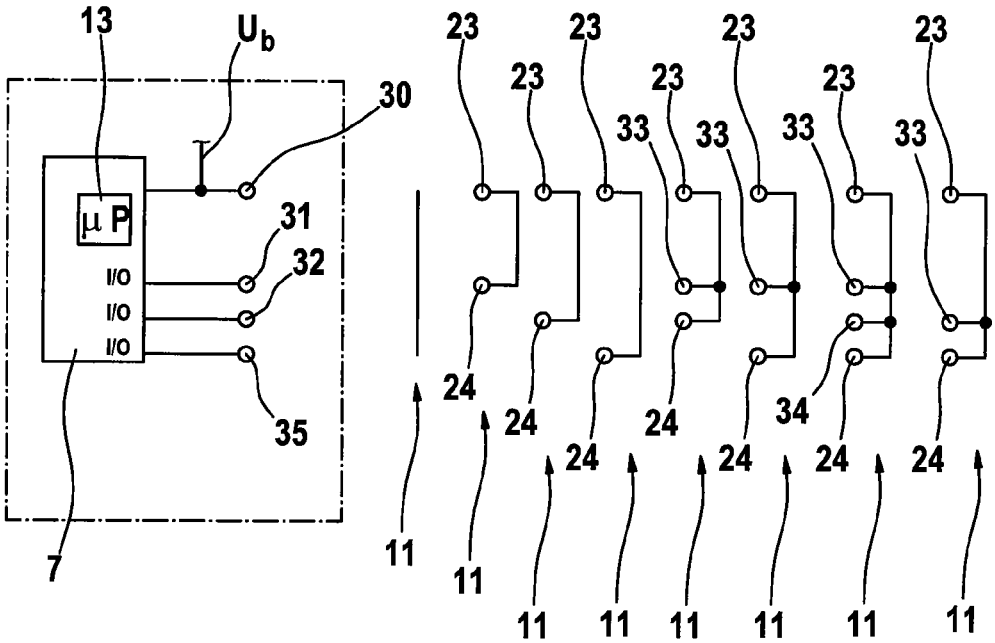
FIG. 5: shows an illustration of a control unit with digital outputs, and differently coded coding units.

FIG. 5 shows an alternative exemplary embodiment of a control unit 7 with a microprocessor 13. The control unit 7 or the microprocessor 13 has a plurality of digital inputs 30, 31, 32, 33 (docking points) for interacting with differently coded coding units 11. As can be seen from FIG. 5, the digital input 30 is supplied with a supply voltage. The heating power and/or the heating temperature is/are predefined by the switching pattern which is predefined by the coding unit 11, that is to say, in particular, by the position and/or number of contact points of the coding unit, said heating power and/or heating temperature then being regulated by the control unit, in particular by means of interaction with a temperature sensor. The right-hand half of the drawing in FIG. 5 diagrammatically illustrates differently coded coding units, the coding being achieved by the provision of different numbers of contact points 23, 24, 33, 34 and/or the arrangement of the contact points 23, 24, 33, 34 at different positions.

Figure 6:
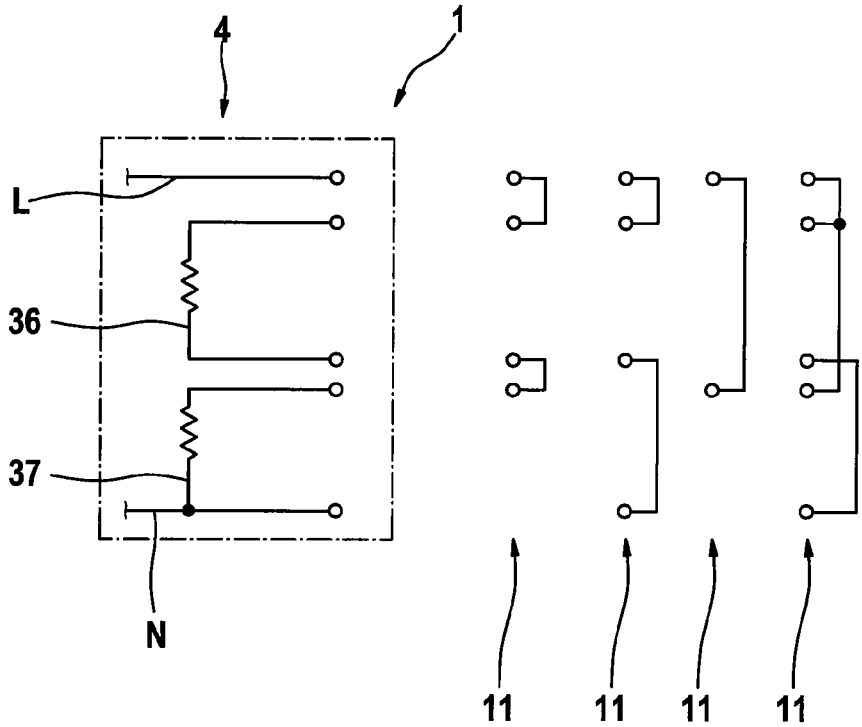
FIG. 6: shows a diagrammatic illustration of an alternative embodiment of a hot air blower having a multipart heating device.

FIG. 6 shows an alternative exemplary embodiment of a highly diagrammatic hot air blower 1. It can be seen that the heating device 4 comprises two heating segments (heating coils) 36, 37. Different connections of the heating elements 36, 37 and thus different heating powers can be achieved with the aid of four differently coded coding units 11 which are illustrated in the right-hand half of the drawing. The heating elements 36, 37 can be connected in series with the first coding unit 11. Only that heating element 36 which is at the top in the plane of the drawing is activated using the second coding unit. The third coding unit activates only that heating element 37 which is at the bottom in the plane of the drawing. The heating elements 36, 37 are connected in parallel with the aid of the fourth coding unit 11 which is illustrated on the far right in the plane of the drawing.

The invention claimed is:

1. A hot air blower comprising:

at least one fan impeller and at least one electrical heating device: said hot air blower being designed to interact with a coding unit which is provided with coding and which is releasably connected to the hot air blower; and said coding unit being designed to predefine a least one of heating power and hot air temperature of a heating device in said hot air blower on the basis of the coding, wherein the heating device has a plurality of heating segments, the heating segments being capable of being connected to one another in different ways on the basis of and/or using the coding of the coding unit, and/or at least one of the heating segments being capable of being selected on the basis of and/or using the coding of the coding unit.

2. The hot air blower according to claim 1, wherein the hot air blower has at least one electrical resistor which can be bridged and/or connected using the coding unit.

3. A hot air blower comprising:

at least one fan impeller and at least one electrical heating device: said hot air blower being designed to interact with a coding unit which is provided with coding and which is releasably connected to the hot air blower; and said coding unit being designed to predefine a least one of heating power and hot air temperature of a heating device in said hot air blower on the basis of the coding, wherein a plurality of series-connected electrical resistors are provided and no resistor is bridged and/or connected using the coding of the coding unit.

4. The hot air blower according to claim 3, wherein the coding unit has electrical component only one electrical line which is arranged on and/or in a printed circuit board.

5. The hot air blower according to claim 3, wherein the coding unit has a plurality of electric lines which are arranged on and/or in a printed circuit board.

6. The hot air blower according to claim 3, where in said coding unit is coded by positioning contact points to electrically contact connect the hot air blower.

7. The hot air blower according to claim 3, wherein a plurality of series connected electrical resistors are provided and at least one resistor is bridged and/or connected using the coding of the coding unit.

8. The hot air blower according to claim 7, wherein a plurality of said resistors is bridged and/or connected using the coding of the coding unit.

9. The hot air blower according to claim 3, wherein at least two of the resistors have different dimensions.

10. The hot air blower according to claim 3, wherein all of the resistors have different dimensions.

11. The hot air blower according to claim 2, wherein the at least one resistor comprises a PTC resistor.

12. The hot air blower according to claim 2, wherein the hot air blower has a control unit which interacts with a temperature sensor and is designed to set the heating power and/or hot air temperature on the basis of the coding of the coding unit.

13. The hot air blower according to claim 12, wherein the at least one resistor which can be bridged by the coding unit is part of an evaluation circuit which is connected to the control unit and is used to determine the coding of the coding unit.

14. The hot air blower according to claim 12, wherein the control unit has a plurality of digital inputs for interacting with the coding unit, and wherein the control unit detects the coding of the coding unit and thus the desired heating power and/or hot air temperature on the basis of the number of contact points contact-connected by the coding unit.

15. The hot air blower according to claim 3, wherein at least sections of the coding unit can be accommodated and releasably secured in an insertion opening.

16. A system comprising a hot air blower according to claim 3, and comprising at least one coding unit which can be releasably connected to the hot air blower and is designed to predefine heating power and/or hot air temperature of a heating device in the hot air blower on the basis of coding.

17. The system according to claim 16, wherein at least two coding units having different coding for different intended uses of the hot air blower are provided.

18. The system according to claim 17, wherein different identification means for identifying a respective intended use are provided on the coding units having the different codings.

19. The system according to claim 17, wherein the different codings are achieved by means of contact points which are arranged at different positions and are intended to electrically contact-connect the hot air blower at different positions.

* * * * *